United States Patent [19]

Vidal

[11] 4,022,470

[45] May 10, 1977

[54] GRIP FOR IMPLEMENT HANDLE

[76] Inventor: Stephen Vidal, 6028 N. 23rd Ave., Phoenix, Ariz. 85015

[22] Filed: Oct. 8, 1975

[21] Appl. No.: 620,655

[52] U.S. Cl. ..... 273/81.5; 273/73 J; 74/558; 29/235

[51] Int. Cl.[2] ..... A63B 53/14

[58] Field of Search ..... 273/67 R, 67 DA, 67 DB, 273/68, 72 R, 73 J, 75, 81 R, 81.5, 81.6; 43/23; 74/551.9, 558, 558.5; 145/61 R, 61 K; 29/235; 150/52 M

[56] References Cited

UNITED STATES PATENTS

| | | | |
|---|---|---|---|
| 1,931,424 | 10/1933 | Barrett | 273/81 R |
| 2,197,409 | 4/1940 | Jackson | 74/558 |
| 2,200,626 | 5/1940 | Lamkin | 273/81.6 |
| 2,721,741 | 10/1955 | Prendergast | 273/81.6 |
| 2,984,486 | 5/1961 | Jones | 273/75 X |
| 3,072,955 | 1/1963 | Mitchell | 273/81 R X |

FOREIGN PATENTS OR APPLICATIONS

| | | | |
|---|---|---|---|
| 16,526 | 9/1893 | United Kingdom | 273/81.5 |

*Primary Examiner*—Richard J. Apley

[57] ABSTRACT

The grip which incorporates the invention is designed for use with implements provided with elongate rigid handles and is particularly suitable for use with tennis rackets, golf clubs, and the like. It consists of an elongate strip of elastomeric material having a high degree of elastic memory and having a generally arcuate shape in cross section in unstressed condition. When applied to the handle of a tennis racket or golf club, for example, a first end is opened out and placed on the free end of the handle, concave side in, and the strip is wrapped in tension over its own first end and then helically along the handle with its concave inner surface in flat facewise contact with the handle without overlap. When it is fully wrapped, the second end is located under the adjacent wrap and secured by friction and elastic pressure. The basic shape and elastic memory cause the marginal edges to constantly press tightly against the handle so that they never curl outward, and the longitudinally extending central portion of the strip is urged outward to provide a cushioning effect.

22 Claims, 7 Drawing Figures

GRIP FOR IMPLEMENT HANDLE

BACKGROUND OF THE INVENTION

This invention lies in the field of gripping surfaces for handles of various kinds including bicycle handle bars and automobile steering wheels but it is directed primarily to grips for the handles or shafts of sporting implements such as tennis rackets and golf clubs. It is more paticularly directed to a grip which is easy to apply and remove, which requires no fasteners to secure it in place, and which provides a superior gripping surface in use.

Most conventional grips for the handles or shafts of athletic implements come in one of two forms and materials. One type is an elongate flat strip of material which is helically wound on the handle from the free end inward for a suitable distance and is usually secured to the handle by an adhesive, with the ends of the strip being further secured by metallic fasteners or string windings. The marginal edges of the turns may be abutted or overlapping. The strip itself may be leather or some plastic imitation.

This type suffers from various disadvantages. Application is expensive and inconvenient because of the need to apply the adhesive and the fasteners and produce a clean and salable product. The adhesive usually deteriorates and allows the marginal edges to become loose so that they quickly curl up with continued use and become uncomfortable. In addition, the curled edges frequently cause blisters. Replacement requires removal of the fasteners and remaining adhesive plus a repetition of the entire initial installation operation. The leather strip absorbs dirt and moisture and is difficult to clean. While the plastic or rubber strip is easier to clean, neither type can be subjected to strong or high temperature cleaning materials and methods because the adhesive would be damaged or destroyed.

Another type of grip is the socket or sleeve which is fitted onto a handle and secured by adhesive or fasteners or both. This type must be a very accurate fit for satisfactory service and requires expensive molding machines and very careful manufacturing and assembly operations. The adhesive is subject to general deterioration, and to damage in cleaning operations, and grip replacement is difficult and time consuming.

Neither type of grip can be readily removed and replaced by the owner of the athletic equipment because of his lack of skill and the necessary tools. Consequently he must pay the high cost of professional repair and replacement.

SUMMARY OF THE INVENTION

The grip incorporating the present invention overcomes the difficulties mentioned above and provides a simple and inexpensive grip unit and method of application, as well as removal and replacement. In addition, the installed grip is superior in both operation and comfort to conventional equipment.

Generally stated, the grip of this invention before installation comprises an elongate strip of elastomeric material, which may be natural or synthetic rubber, having a high degree of elastic memory and having a generally arcuate shape in cross section in unstressed condition throughout at least the major part of its length. It may be deformed to a practically flat shape but its elastic memory constantly urges it back toward its original arcuate cross section.

To install the grip in place, the first end of the strip is deformed to a relatively flat condition and its concave face is laid on the free end of the handle tangent to its periphery, and the strip is wound around the handle to overlie the first end while stretching the strip to exert elastic pressure on the first end and secure it in place. The remainder of the strip is kept in stretching tension and wound helically inward on the handle with its initially concave inner surface in substantially flat facewise contact with the surface of the handle substantially throughout the width of the strip. The wraps are so laid that one marginal edge of each turn is adjacent to the opposed marginal edge of each preceding turn, preferably with all marginal edges in abutting contact and also in contact with the surface of the handle. The strip is initially sized to produce the desired length of installed grip on the handle and, when a fractional turn remains, the second end of the strip is located under the previous turn. Since this turn is wrapped under tnesion it grips the second end elastically between itself and the handle so that the free end is frictionally held in place, and the strip will not loosen or become unwrapped from the handle.

Since every portion of the length of the strip is trying to return to its initial arcuate shape the marginal edges are continually pressed tightly against the surface of the handle and will not curl outwardly even if there are some gaps between the turns. The same elastic memory continually urges the longitudinal central portion of the strip outwardly away from the handle and produces a cushioning effect.

A variety of materials may be used for the strip to satisfy the requirements of different individuals and different types of use. Natural and synthetic rubber compounds may be used so long as they have a high degree of elastic memory and sufficient tack or frictional drag to ensure that the strip will not slip on the handle and the grip will not slip in an operator's hands. The elastic memory should be sufficient to cause the strip to return almost completely to its initial size and shape after it has been deformed and external stresses have thereafter been released.

The arcuate extent of the unstressed strip may vary from about 180° to approximately a full circle of 360°, which is preferred. An extrusion resembling a tube with a line of division extending longitudinally may be used to produce the strip but it is presently preferred to use a complete tube and slit it longitudinally.

The strip, whether of minimum or maximum arcuate extent, is essentially single thickness and homogeneous. It is possible to utilize a laminate of two or more layers bonded together to achieve required elasticity and frictional texture, but not discrete layers.

While various degrees of stretch may be employed, it has been determined that very satisfactory results are obtained with the selected material when the final installed length of the strip is of the order of 150 percent of the initial unstressed length.

It has also been determined that the superior results deriving from the shape and elastic memory of the strip are best obtained when the wall thickness is substantially constant throughout. The outward urge of the central portion of the strip tends to absorb the shock of driving a ball and also gives the operator a very secure grasp without the exercise of excessive pressure.

It will be apparent that the grip incorporating the features of the invention may be applied as original equipment with great ease and at very low cost, and that the owner of an implement may readily remove and replace it or add the grip to any implement not already equipped with it.

BRIEF DESCRIPTION OF THE DRAWINGS

Various other advantages and features of novelty will become apparent as the description proceeds in conjunction with the accompanying drawings, in which.

DESCRIPTION OF PREFERRED EMBODIMENTS

Figure 1:
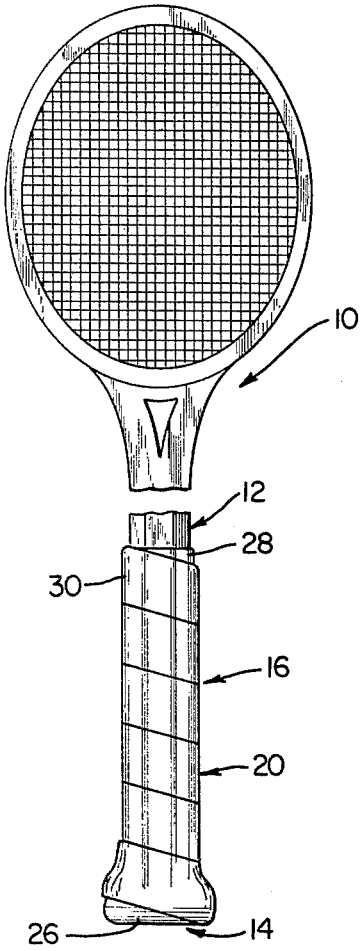
FIG. 1 is an elevational view of a tennis racket equipped with the grip which incorporates the features of the invention.

The general manner of application of the grip of this invention is illustrated in FIG. 1, in which a tennis racket 10 has a handle 12 with a free end 14, a grip 16 being mounted on the handle. The free end 14 is provided with an annular enlargement, indicated in FIG. 2 by 18, which is generally in the form of a leather ferrule. Grip 16 comprises an elongate strip 20 of elastomeric material having a high degree of elastic memory which has a generally arcuate shape in cross section in unstressed condition throughout at least the major portion of its length.

Figure 5:
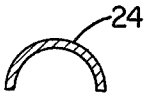
FIG. 5 is a view similar to FIG. 4 showing an arcuate strip subtending an angle of about 180°.
Figure 4:
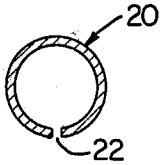
FIG. 4 is a cross sectional view of the preferred form of strip in unstressed condition.

The preferred cross sectional form, as illustrated in FIG. 4, is a substantially complete circle having a line of division 22 extending longitudinally to enable it to be opened out to substantially flat condition. Excellent results have been obtained by using complete tubing and slitting it longitudinally along line 22. It is also possible, but less desirable, to use a strip having in unstressed condition a lesser arcuate extent such as strip 24 shown in FIG. 5 which subtends an angle of the order of 180°. This is about the minimum useful subtended angle and requires very expensive elastic material as well as greater thickness to obtain the necessary elastic properties. The unstressed cross section need not fall on a true circular arc but may have any suitable arched shape such as oval, hexagon or octagon. The terms arc and arcuate as used herein are to be understood as applying to such suitable configurations.

A high degree of elastic memory means that the material must possess considerable elastic resistance to the force tending to flatten it out and must elastically return very close to its original unstressed shape even after long periods of distortion into the shape in which it is used as a grip.

To install the grip in place, the first end 26 of the strip 20 is deformed to a relatively flat condition and its concave face is laid on the free end 14 of the handle tangent to its periphery, and the strip is wound around the handle sufficiently to overlie its own first end while stretching the strip to exert elastic pressure on the first end and frictionally secure it in place. The remainder of the strip is kept in stretching tension and wound helically inward on handle 12 with its initially concave inner surface in flat facewise contact with the surface of the handle substantially throughout the width of the strip.

The wraps are so laid that one marginal edge of each turn is adjacent to the opposed marginal edge of each preceding turn, preferably with all marginal edges in abutting contact and also in contact with the surface of handle 12. Strip 20 is initially sized to produce the desired length of installed grip on the handle and, when a fractional turn remains, the second end 28 of the strip is located under the previous turn 30. Since this turn is wrapped under tension it grips end 28 elastically between itself and the handle so that end 28 is frictionally held in place, and the strip will not loosen or become unwrapped from the handle.

Various materials may be used for the strip to satisfy different requirements. Natural or synthetic rubber compounds may be used so long as they have a high degree of elastic memory and sufficient tack or frictional drag to ensure that the strip will not slip on the handle and the grip will not slip in an operator's hands. The strip is essentially single thickness and homogeneous. It is possible to utilize a laminate of two or more layers bonded together to achieve the required elasticity and frictional texture, but not discrete layers.

Figure 2:
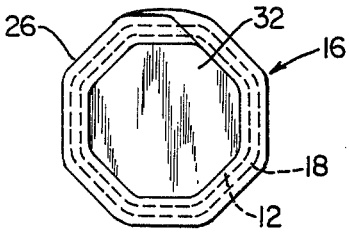
FIG. 2 is an end view of the racket of FIG. 1 showing the relation of the grip to the end face of the handle.

The wrapping may be started inward of the ferrule or exactly at the end of the handle but added utility may be gained if the first turn or wrap is so laid that the outer marginal edge extends beyond the handle a short distance. Because of its initial cross sectional shape and elastic memory, the margainl portion of the strip will curl inward over the end face 32 of the handle and form an annular cushioning buffer to protect the end of the handle, as illustrated in FIG. 2.

Figure 3:
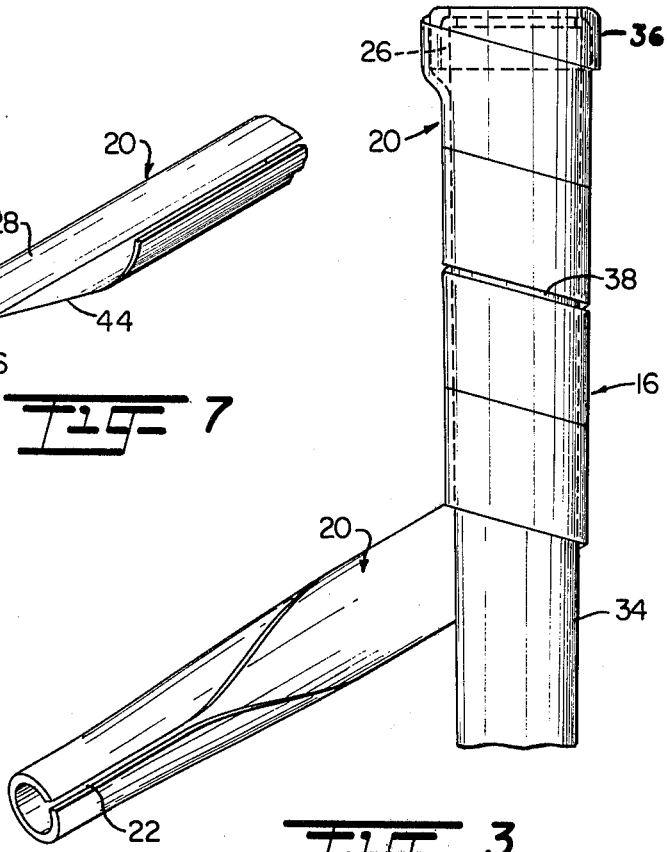
FIG. 3 is an elevational view of the handle or shaft of a golf club with a grip unit partially installed.

The strip 20 may be applied to the handle 34 of a golf club shaft in substantially the same way, as illustrated in FIG. 3. This figure also shows the manner in which the strip material curls in over the end face to form a cushioning buffer. The handle may or may not be provided with a ferrule at its free end. In this figure the handle is shown as having no end ferrule and instead a second turn 36 is wrapped to overlie end portion 26 to produce the equivalent of a ferrule, and is then wrapped helically for the remainder of its length. As can be seen in the lower portion of the figure, the portion of strip 20 which is not wrapped on the handle or immediately adjacent thereto maintains its initial cross sectional shape, as in FIG. 4, and is gradually opened out and flattened as the application proceeds.

While trained technicians working on factory installations can readily wrap the strip on a handle without a gap between turns, the owner of an implement who removes and replaces a strip or applies a new one for the first time may experience some difficulty in maintaining uniform tension and angle of wrap, resulting in one or more gaps such as shown in exaggerated form at 38. The owner may remove the strip and repeat the operation or he may choose to leave the gap if it is fairly small. This will not cause any deterioration or disadvantage in use because the marginal edges at the gap will not curl outward.

Figure 6:
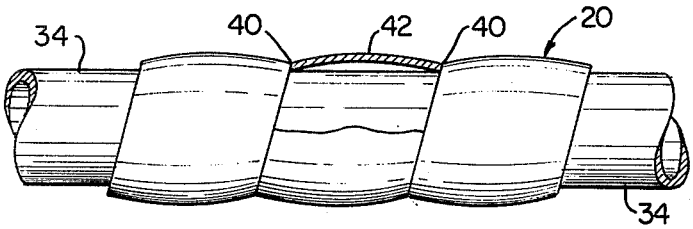
FIG. 6 is a side elevational view of a portion of a handle with an exaggerated showing in section of the elastic action of the strip.

The action of the installed strip is illustrated in exaggerated form in FIG. 6. The elastic memory causes the marginal edges 40 to continually press inward against the surface of the handle and at the same time urges the longitudinally extending central portion 42 outward away from the surface of handle 34, as indicated by the arrows. In actual practice the strip is wrapped tightly enough so that the gap under portion 42 is minimal. However, if it is desired to obtain a more pronounced cushioning effect, it can be wrapped to provide a substantial gap such as shown in the exaggerated view. Every turn will still stay in place and edges 40 will not curl outward.

Figure 7:
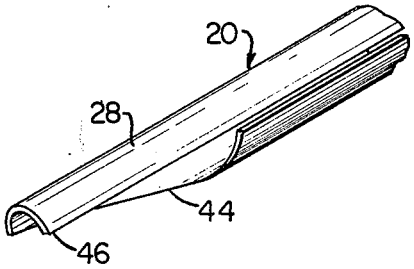
FIG. 7 is a perspective view of an end portion of a typical strip.

In order to simplify the operation of securing the second end 28 of the strip 20 at the conclusion of the wrapping operation by locating it under the previous turn 30 it is desirable to make a tapering cut 44 as shown in FIG. 7 to produce a narrow tip end 46 which is relatively easy to manipulate. While it is not essential to provide a similar formation on the first end 26 it may be done in order to reduce the bulk at the free end of the handle.

Optimum results are obtained with a proper selection of strip width and thickness. In the preferred form of substantially a full tube with a longitudinal line of division, the tube diameter should be in the range of three-eighths inch to five-eighths inch with about one-half inch preferred, and the thickness should be in the range of 5 to 8 percent of the peripheral extent of the unstressed strip with about 6 percent being preferred. The actual production strip is made from a slit tube having an outside diameter of about one-half inch and a wall thickness of about 0.080 inch.

When a strip is made from generally arcuate material subtending an angle of the order of 180° the thickness ratio must be increased to obtain adequate inward pressure at the strip margins, and the thickness should be in the range of 8 to 12% of the peripheral extent of the unstressed strip with about 10 percent being preferred.

What is claimed is:

1. A grip for use in combination with a rigid elongate implement handle comprising:

an elongate strip of elastomeric material of substantially greater length than width having a high degree of elasticity and of elastic memory;

the strip in unstressed condition extending longitudinally in a substantially straight line with the margins of the strip being parallel to each other and to the axis of the strip, and having a generally arcuate shape in cross section laterally of the axis of the strip throughout at least the major portion of its length;

the strip having a uniform thickness and being smooth on both faces and being formed of a material which has high friction characteristics;

the strip being adapted to be arranged on an elongate implement handle in helically wound form in substantial longitudinally stretched condition and with its initially concave inner surface in flat facewise contact with the surface of the handle substantially throughout the width of the strip, and with one marginal edge of each helical turn arranged adjacent to the opposed marginal edge of each preceding turn;

the elastic memory of the material being sufficient to cause the free marginal edges of the strip to press tightly against the surface of the handle.

2. A grip as claimed in claim 1; in which the peripheral extent of the unstressed strip cross section subtends a minimum angle of approximately 180 degrees.

3. A grip as claimed in claim 1; in which the peripheral extent of the unstressed strip cross section encompasses an angle of the order of 360 degrees.

4. A grip as claimed in claim 1; in which the strip in unstressed condition comprises a length of cylindrical tubing having a longitudinal line of division in its wall to enable deformation into substantially flat strip form.

5. A grip as claimed in claim 1; in which the elasticity of said strip is such that the final stretched installation length of the strip is of the order of 150 percent of its initial unstressed length.

6. A grip as claimed in claim 1; in which the strip has a peripheral extent in unstressed condition subtending an angle of the order of 360°;

and the thickness of the strip is in the range of about 5 to 8 percent of the peripheral extent.

7. A grip as claimed in claim 1; in which the strip has a peripheral extent in unstressed condition subtending an angle of the order of 360°;

and the thickness of the strip is of the ordder of 6 percent of the peripheral extent of the strip.

8. A grip as claimed in claim 1; in which the strip has a peripheral extent in unstressed condition subtending an angle of the order of 180°;

and the thickness of the strip is in the range of 8 to 12 percent of the peripheral extent.

9. A grip as claimed in claim 1; in which the strip comprises a length of tubing having a longitudinal slit;

the diameter of the tubing is of the order of 1/2 inch;

and the wall thickness of the tubing is of the ordder of 0.080 inch.

10. The combination of an implement and a grip therefor, comprising:

an implement having a rigid elongate handle with a free end and a grip adapted to circumscribe the handle in the vicinity of its free end;

the grip consisting of an elongate strip of elastomeric material of substantially greater length than width having first and second ends and having a high degree of elasticity and of elastic memory;

the strip in unstressed condition extending longitudinally in a substantially straight line with the margins of the strip being parallel to each other and to the axis of the strip, and having a generally arcuate shape in cross section laterally of the strip throughout at least the major portion of its length;

the strip having a uniform thickness and being smooth on both faces and being formed of a material which has high friction characteristics;

the strip being mounted on the handle with its first end at the free end of the handle and arranged in helically wound form to cover the handle from its free end inwardly to a suitable extent;

the strip being in substantial longitudinally stretched condition and with its initially concave inner surface in flat facewise contact with the surface of the handle substantially throughout the width of the strip;

one marginal edge of each helical turn being adjacent to the opposed marginal edge of each preceding turn;

the elastic memory of the material causing the free marginal edges of the strip to press tightly against the surface of the handle;

and the ends of the strip being secured to prevent loosening and unwrapping of the strip from the handle as a result of use of the implement.

11. The combination as claimed in claim 10; in which the peripheral extent of the unstressed strip cross section subtends an angle in the range of 180° to 360°.

12. The combination as claimed in claim 10; in which the peripheral extent of the unstressed strip cross section encompasses an angle of the order of 360°.

13. The combination as claimed in claim 10; in which the final stretched installed length of the strip is of the order of 150 percent of its initial unstressed length.

14. The combination as claimed in claim 10; in which the elastic memory of the material acts to urge the longitudinally extending center portion of the strip away from the underlying handle surface to produce a cushioning effect.

15. The combination as claimed in claim 10; in which the marginal edges of adjacent turns of the strip are substantially in edgewise contact with each other and also in direct contact with the handle surface to preclude overlapping of the turns and to define a substantially smooth and continuous grip surface.

16. The combination as claimed in claim 10; in which the ends of the strip are located beneath the adjacent turns of the strip and are held secure by their frictional engagement with the strip and the handle maintained by the elastic pressure of the overlying strip portions.

17. The combination as claimed in claim 10; in which the first end of the strip is wrapped on itself around the free end of the handle in a position to partially overlie the end face and form a cushioning buffer.

18. The combination as claimed in claim 10; in which the first end of the strip is wrapped on itself through approximately two turns to form an annular enlargement on the free end of the handle.

19. A method of applying a grip to an implement handle having a free end comprising:

providing an elongate strip of elastomeric material having a high degree of elastic memory and having a generally arcuate shape in cross section in unstressed condition throughout at least the major portion of its length;

applying a first end of the strip with its concave surface inward to the handle at its free end and wrapping the strip over its first end under tension to secure it in position by friction and elastic pressure;

wrapping the strip helically on the handle with sufficient continuing tension to cause the initially concave inner surface to lie in flat facewise contact with the surface of the handle substantially throughout the width of the strip and with one marginal edge of each helical turn adjacent to the opposed marginal edge of the preceding turn until substantially the entire strip has been wrapped on the handle;

and locating the second end of the strip under the previous wrap to secure it against displacement by friction and elastic pressure.

20. The method as claimed in claim 19; including the step of wrapping the first end of the strip around the tip end of the handle in a position to partially overlie the end face and form a cushioning buffer.

21. The method as claimed in claim 19; in which sufficient tension is applied to the strip during wrapping to cause its final installed length to be about 150 percent of its initial unstressed length.

22. The method as claimed in claim 21; in which the elongate strip of generally arcuate cross section is produced by selecting a piece of elastic tubing of appropriate length and slitting the wall longitudinally to enable an operator to open the tube out to generally flat form.

* * * * *

UNITED STATES PATENT OFFICE

CERTIFICATE OF CORRECTION

Patent No. 4,022,470 Dated May 10, 1977

Inventor(s) Stephen T. Vidal

It is certified that error appears in the above-identified patent and that said Letters Patent are hereby corrected as shown below:

In column 8 line 33 change "21" to --19--.

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*